US008287232B2

(12) United States Patent
Gu et al.

(10) Patent No.: US 8,287,232 B2
(45) Date of Patent: Oct. 16, 2012

(54) COMPRESSOR WITH CONTROLLABLE RECIRCULATION AND METHOD THEREFOR

(75) Inventors: Ronglei Gu, Saitama (JP); Masahiko Yashiro, Saitama (JP)

(73) Assignee: Honeywell International Inc., Morristown, NJ (US)

( * ) Notice: Subject to any disclaimer, the term of this patent is extended or adjusted under 35 U.S.C. 154(b) by 1317 days.

(21) Appl. No.: 11/628,687

(22) PCT Filed: Jun. 7, 2004

(86) PCT No.: PCT/US2004/017819

§ 371 (c)(1),
(2), (4) Date: Jan. 9, 2008

(87) PCT Pub. No.: WO2005/121559

PCT Pub. Date: Dec. 22, 2005

(65) Prior Publication Data

US 2008/0232952 A1 Sep. 25, 2008

(51) Int. Cl.
*F04D 29/66* (2006.01)

(52) U.S. Cl. ..... 415/56.5; 415/57.1

(58) Field of Classification Search ..... 415/56.4, 415/56.5, 57.1, 58.4, 144, 145
See application file for complete search history.

(56) References Cited

U.S. PATENT DOCUMENTS 2,656,096 A * 10/1953 Schwarz ..... 417/323
5,173,021 A 12/1992 Grainger et al.

FOREIGN PATENT DOCUMENTS

DE 10223876 11/2003
GB 2058218 A * 4/1981
JP 310699 3/1998

OTHER PUBLICATIONS

PCT ISR/WO PCT/US2004-017819.

* cited by examiner

*Primary Examiner* — Dwayne J White
(74) *Attorney, Agent, or Firm* — Alston & Bird LLP

(57) ABSTRACT

There is provided a compressor (10) and an associated method for controlling a recirculation flow to control surging in the compressor. The compressor includes a housing (12) and a compressor wheel (16) mounted therein. A recirculation passage (41) receives compressed air from the compressor and recirculates the compressed air to an inlet passage (20) of the housing and, in particular, to leading edges (32) of blades (18) of the compressor wheel. An adjustable flow control device (60) is configured to control the flow of the compressed air through the recirculation passage to control a surge characteristic of the compressor. For example, the flow control device can include one or more valves (V1, V2, V3), each of which can be adjusted by an actuator (64).

25 Claims, 8 Drawing Sheets

| V2 | V1 | FLOW RATE |
|---|---|---|
| CLOSED | CLOSED | 1 (OFF) |
| CLOSED | OPEN | 2 |
| OPEN | CLOSED | 3 |
| OPEN | OPEN | 4 |

| V3 | V2 | V1 | FLOW RATE |
|---|---|---|---|
| CLOSED | CLOSED | CLOSED | 1 (OFF) |
| CLOSED | CLOSED | OPEN | 2 |
| CLOSED | OPEN | CLOSED | 3 |
| CLOSED | OPEN | OPEN | 4 |
| OPEN | CLOSED | CLOSED | 5 |
| OPEN | CLOSED | OPEN | 6 |
| OPEN | OPEN | CLOSED | 7 |
| OPEN | OPEN | OPEN | 8 |

COMPRESSOR WITH CONTROLLABLE RECIRCULATION AND METHOD THEREFOR

FIELD OF THE INVENTION

The present invention relates generally to compressor systems, such as a compressor for use in a turbocharger for an internal combustion engine, and more particularly relates to controllable recirculation in such a compressor to prevent or reduce the occurrence of surging.

BACKGROUND OF THE INVENTION

Turbochargers are typically used to increase the power output of an internal combustion engine such as in an automobile or other vehicle. A conventional turbocharger includes a turbine and a compressor. The turbine is rotatably driven by the exhaust gas from the engine. A shaft connects the turbine to the compressor and thereby rotates the compressor. As the compressor rotates, it compresses air that is then delivered to the engine as intake air. The increase in pressure of the intake air increases the power output of the engine. In a typical turbocharger for an internal combustion engine of an automobile, the compressor is a centrifugal compressor, i.e., air enters the compressor in a generally axial direction and exits the compressor in a generally radial direction.

Compressor surge refers to a generally undesirable operating condition in which the flow begins to separate on the compressor blades because of excessive incidence angle. Surge typically occurs when the compressor is operated with a relatively high pressure ratio and with low flow therethrough. For example, compressor surge can occur when the engine is operating at high load or torque and low engine speed, or when the engine is operating at a low engine speed with a high rate of exhaust gas recirculation from the engine exhaust side to the intake side. Compressor surge can also occur when a relatively high specific power output, e.g., more than about 70 to 80 kilowatts per liter, is required of an engine with an electrically assisted turbocharger. Additionally, surge can occur when a quick boosting response is required using an electrically assisted turbocharger and/or variable nozzle turbine (VNT) turbocharger, or when the engine is suddenly decelerated, e.g., if the throttle valve is closed while shifting between gears.

As a result of any of the foregoing operating conditions, the compressor can surge as the axial component of absolute flow velocity entering the compressor is, low in comparison to the blade tip speed in the tangential direction, thus resulting in the blades of the compressor operating at a high incidence angle, which leads to flow separation and/or stalling of the blades. Compressor surge can cause severe aerodynamic fluctuation in the compressor, increase the noise of the compressor, and reduce the efficiency of the compressor. In some cases, compressor surge can result in damage to the engine or its intake pipe system.

JP Publication No. 09310699 discloses a centrifugal compressor in which a plurality of slits 16 pierce a periphery of a suction part casing 11 for partially supplying discharge fluid to an air reservoir 17 through a flow control valve 19. Fluid flowing to an impeller 13 is previously whirled round to decrease the angle of attack at low flow to prevent surging. The flow control valve 19 can be closed if the flow therethrough is not needed to prevent losses.

DE 102 23 876 A1 illustrates a turbocharger in which air can be directed from the volute to the inlet. For example, as shown in FIGS. 4 and 5, air can flow from the volute 21 via member 31 and passage 29 to the compressor inlet.

U.S. Pat. No. 2,656,096 to Schwarz, directed to a centrifugal pump and compressor, discloses that exhaust ports are provided in the side walls of a diffuser. The exhaust ports can be connected to the suction pipe or intake of the apparatus so that the fluid of the boundary layers in the diffuser is sucked out from the diffuser, and the fluid can used to cool the blades and wheels of a turbine.

DE 198 23 274 C1 illustrates a turbocharger that also provides for circulation of gas from the volute to the intake. For example, as shown in the figures, a passage 4 can connect the volute to the intake so that air flows in the indicated direction from the volute to the intake.

Nevertheless, there exists a need for an improved apparatus and method for providing compressed gas, such as in a turbocharger, while reducing the occurrence of compressor surge. In some cases, the prevention of compressor surge can expand the useful operating range of the compressor.

BRIEF DESCRIPTION OF THE SEVERAL VIEWS OF THE DRAWINGS

Figure 1:
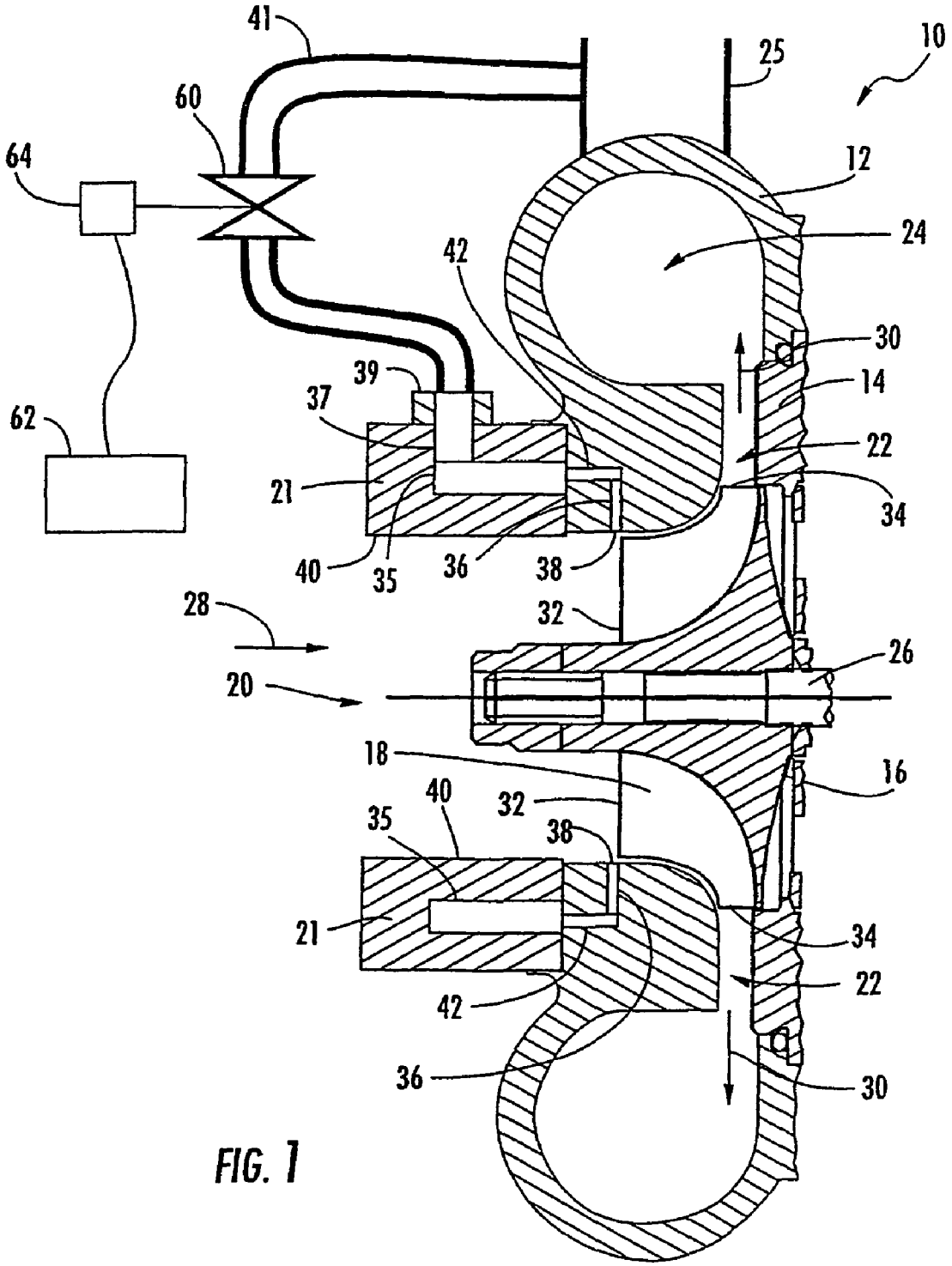
Figure 2:
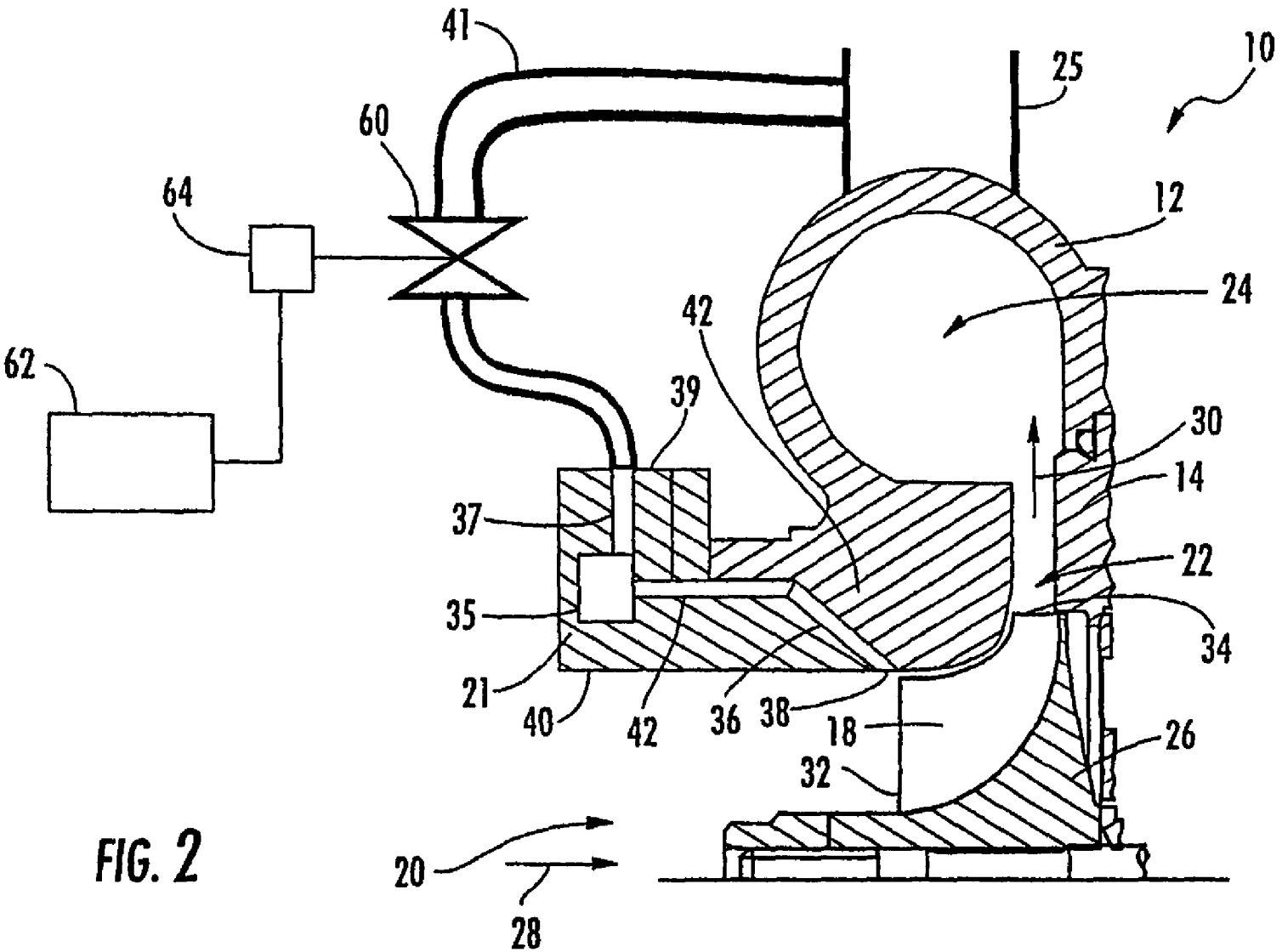
Figure 3:
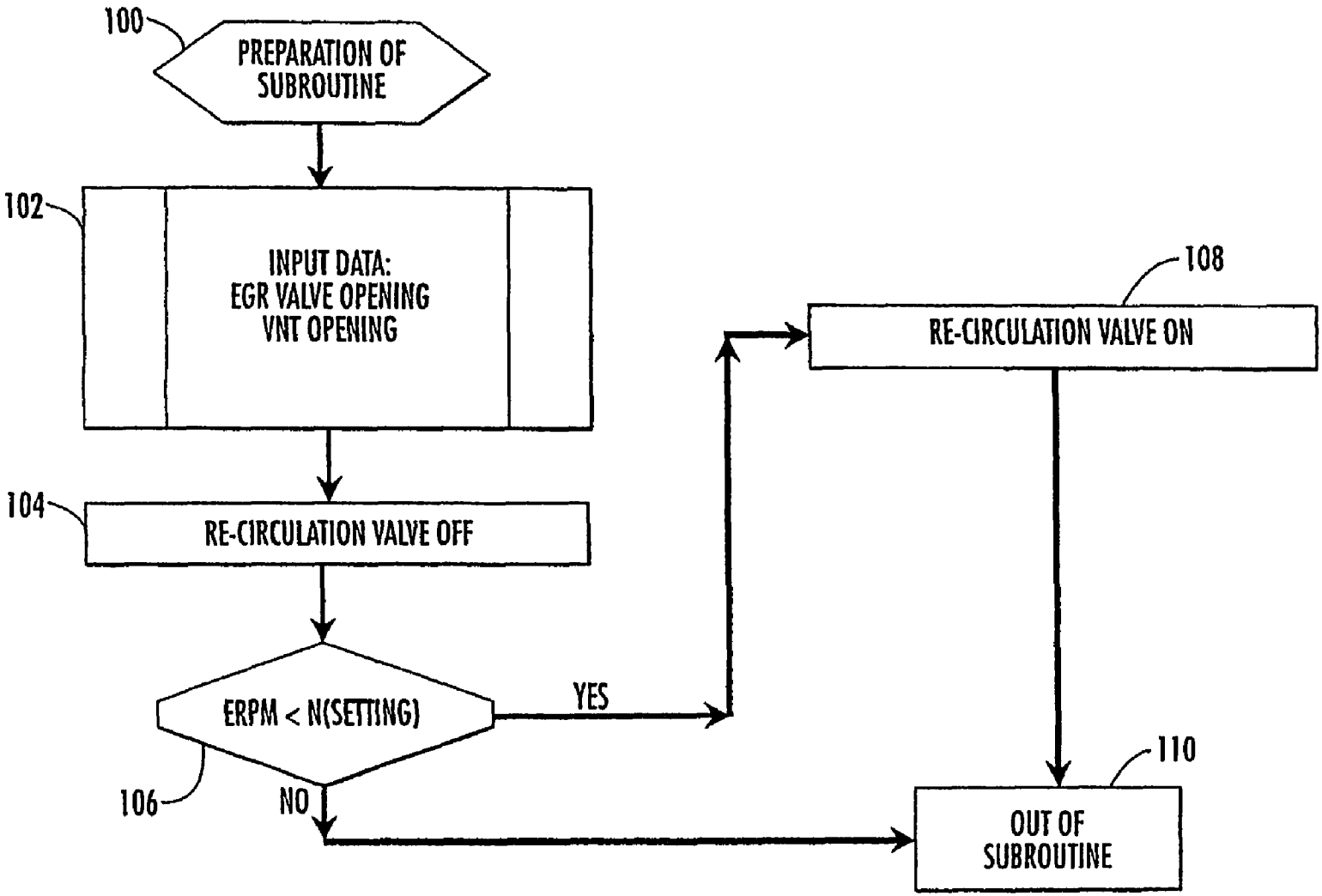
Figures 4, 4A:
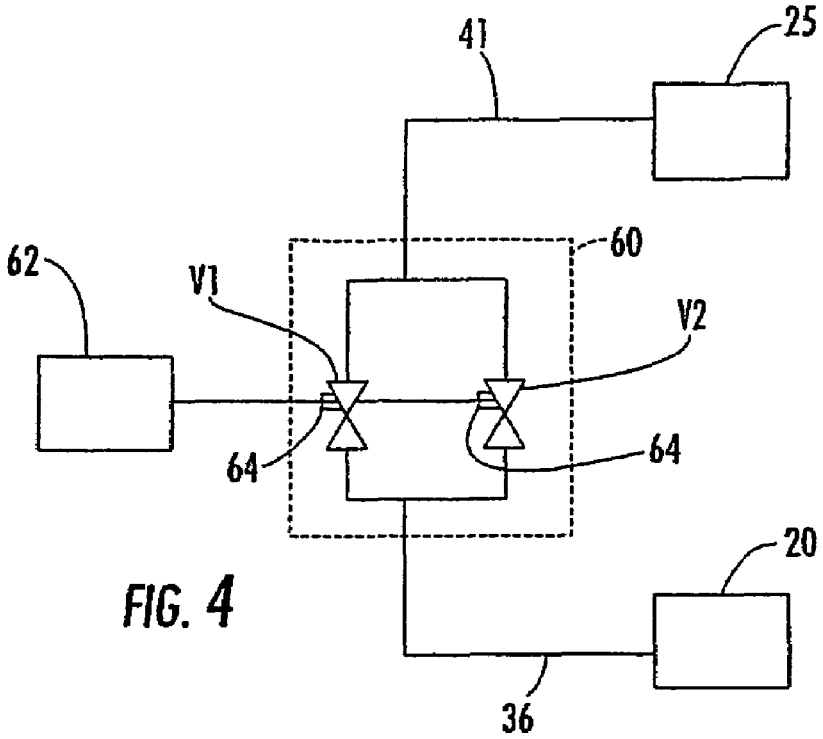
Figures 5, 5A:
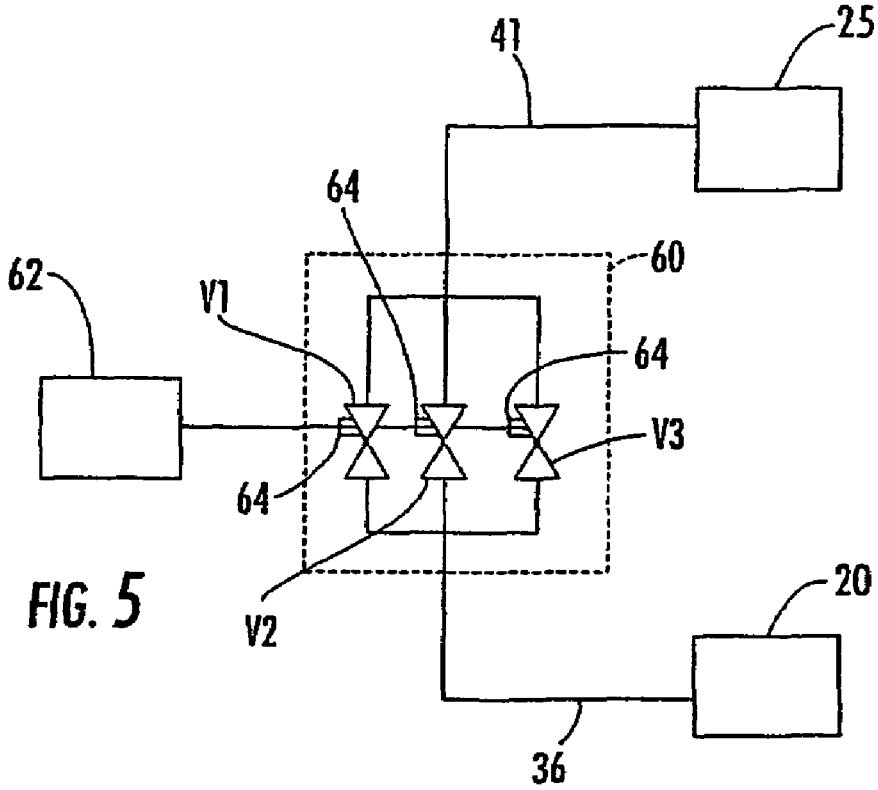
Figure 6:
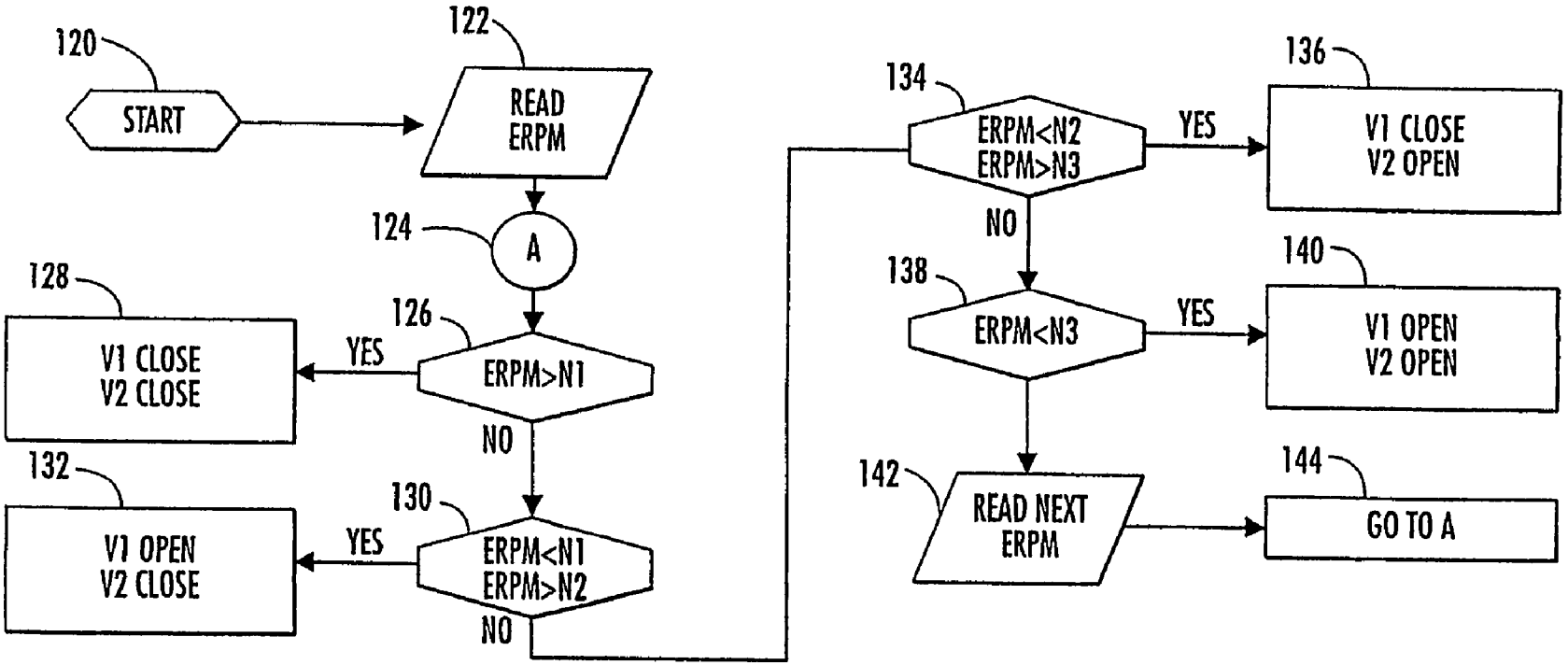
Figure 7:
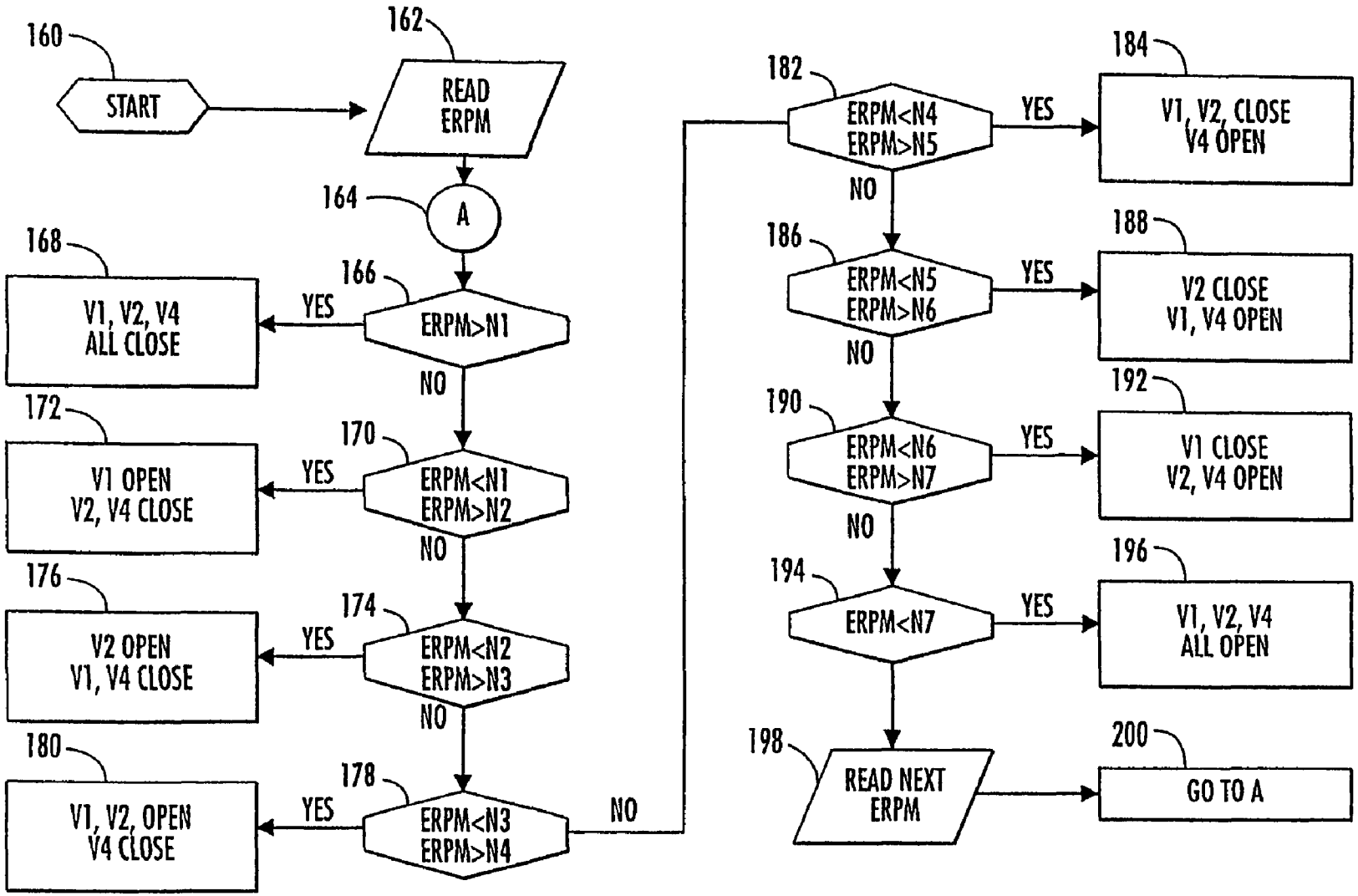
Figure 8:
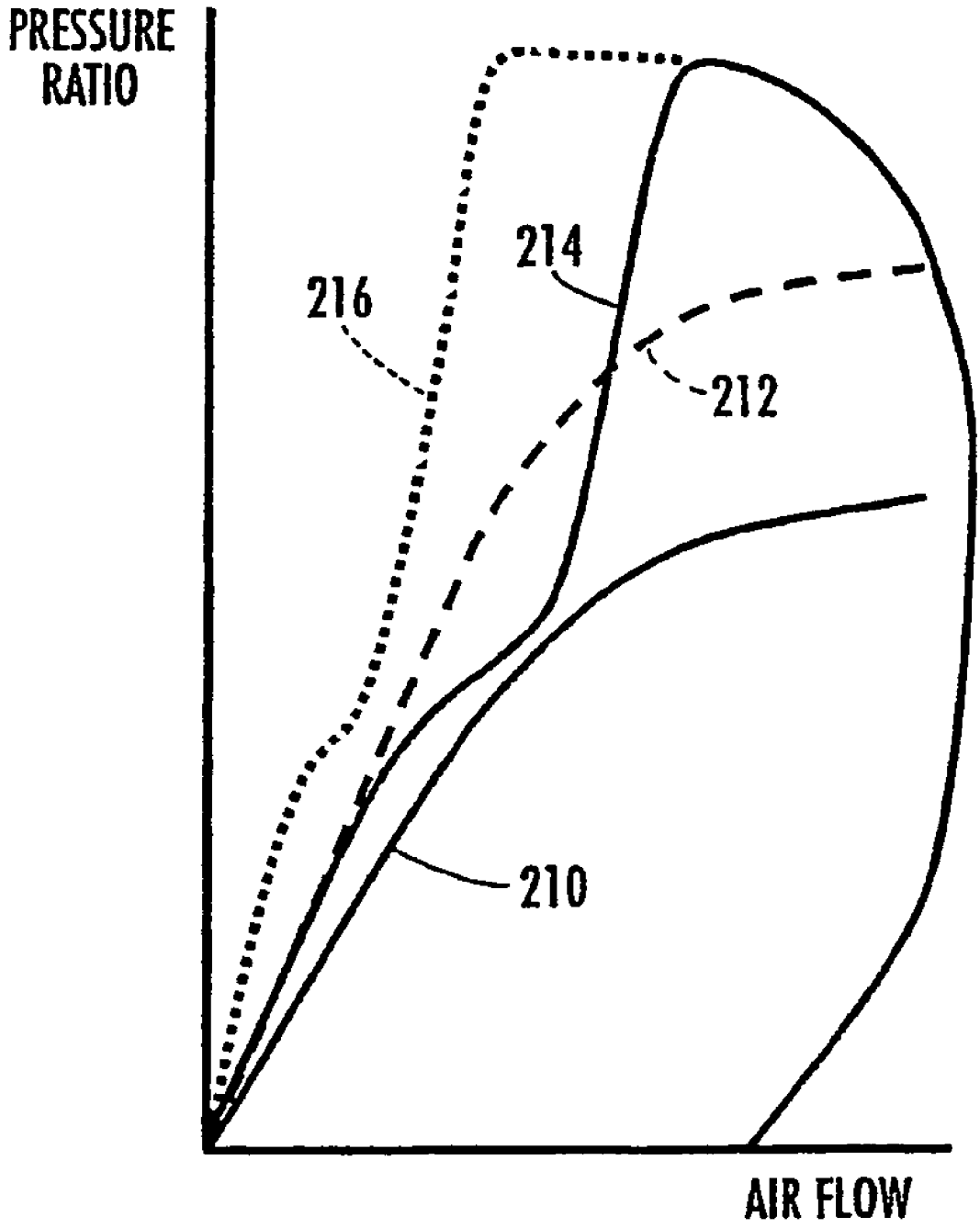

Having thus described the invention in general terms, reference will now be made to the accompanying drawings, which are not necessarily drawn to scale, and wherein:

FIG. 1 is section view in elevation illustrating a compressor according to one embodiment of the present invention;

FIG. 2 is a partial section view in elevation illustrating a compressor according to another embodiment of the present invention;

FIG. 3 is a flow chart schematically illustrating the operation of a compressor according to one embodiment of the present invention for a compressor with a single valve for controlling a recirculation flow;

FIG. 4 is a schematic diagram illustrating a flow control device with two valves according to one embodiment of the present invention;

FIG. 4A is a chart illustrating various configurations of the flow control device of FIG. 4 and the corresponding recirculation flow rates;

FIG. 5 is a schematic diagram illustrating a flow control device with three valves according to another embodiment of the present invention;

FIG. 5A is a chart illustrating various configurations of the flow control device of FIG. 5 and the corresponding recirculation flow rates;

FIG. 6 is a flow chart schematically illustrating the operation of a compressor according to another embodiment of the present invention for a compressor with two valves for controlling a recirculation flow;

FIG. 7 is a flow chart schematically illustrating the operation of a compressor according to yet another embodiment of the present invention for a compressor with three valves for controlling a recirculation flow; and FIG. 8 is a graph illustrating the typical operating conditions of a compressor according to one embodiment of the present invention compared to the operating conditions of a conventional compressor.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the figures and, in particular, FIG. 1, there is shown a compressor 10 according to one embodiment of the present invention. The compressor 10 can be used in a turbocharger, e.g., to provide compressed intake air for an internal, combustion engine in a vehicle. Alternatively, the compressor 10 can be used in other devices and/or for compressing gases other than air. Thus, while the operation of the compressor 10 is described below as compressing air for use in an internal combustion engine, it is understood that the compressor 10 is not limited to such a function and can be used in various other applications. Further, it is appreciated that the intake air delivered through the compressor 10 can include additional gases, such as exhaust gas that is recirculated from the engine.

As shown in FIG. 1, the compressor 10 includes a housing 12 and a backplate 14. A compressor wheel 16 is rotatably mounted in the housing 12, and blades 18 on the compressor wheel 16 are configured to direct air from an axial inlet passage 20 to a diffuser passage 22 and therethrough to a volute 24. From the volute 24, the compressed air exits the compressor through an exit 25, which can be connected, e.g., to the intake of an engine. The compressor wheel 16 is connected to a shaft 26 that extends from the compressor 10, e.g., to connect to a turbine wheel in a turbine housing (not shown) so that the compressor wheel 16 rotates with the turbine wheel. As the compressor wheel 16 rotates in the housing 12, the blades 18 deliver air from the inlet passage 20 to the diffuser passage 22 and volute 24. Thus, air flows into the compressor 10 in a generally axial direction 28 and then through the diffuser passage 22 and volute 24 to the exit 25 in a generally radial direction 30. Each of the blades 18 of the compressor wheel 16 defines a leading edge 32 and a trailing edge 34, and the blades 18 can define a complex three-dimensionally curved contour.

The housing 12 includes an inlet duct 21 that defines one or more injection ports 36 that are configured to receive compressed air from the compressor wheel 16 and recirculate the compressed air to the inlet passage 20. Each injection port 36 defines an outlet 38 on a radially inner surface 40 of the housing 12. For example, as shown in FIG. 1, each injection port 36 is configured to receive a flow of recirculated air from a recirculation passage 41. The recirculation passage 41 is typically a pipe, hose, or other tubular member, which can be outside the housing 12. In some embodiments, the passage 41 can be defined by the housing 12, i.e., as an internal passage defined by the housing as described in copending International Application No. PCT/US2004/017866, titled "COMPRESSOR APPARATUS AND METHOD WITH RECIRCULATION," filed on Jun. 7, 2004. The recirculation passage 41 is fluidly connected to the exit 25 at any of various positions upstream or downstream of the exit 25. For example, the recirculation passage 41 can receive the compressed air directly from the diffuser passage 22, the volute 24, the exit 25 or after the air has flowed through the exit 25. In any case, the recirculation passage 41 receives the compressed air from the compressor 10 and directs the air to the inlet duct 21.

The inlet duct 21 defines a connection port 37 that extends from an outer surface 39 of the duct 21 to a circumferential chamber 35 of the duct 21. Thus, the recirculation passage 21 can be connected to the connection port 37 by any of various connectors and thereby fluidly connected to the chamber 35. The chamber 35, in turn, is connected to the injection port 36 by one or more flow channels 42 that extend in a generally axial direction through the duct 21. In other embodiments of the present invention, the circumferential chamber 35, connection port 37, and flow channels 42 can be otherwise configured to provide the flow of the recirculated air from the recirculation passage 41 to the injection port 36.

Further, each of the injection ports 36 and the flow channels 42 can be a bore, slot, or other passage defined by the duct 21. For example, a plurality of the flow channels 42 and injection ports 36 can be provided at circumferentially spaced positions around the surface 40 defining the inlet passage 20. Each flow channel 42 and injection port 36 can be a cylindrical bore extending through the duct 21. Thus, the recirculated air can flow generally circumferentially in the chamber 35 and then through the individual flow channels 42 and injection ports 36 to the inlet passage 20. Any number of the flow channels 42 and injection ports 36 can be provided.

The outlet 38 of each port 36 is defined on the radially inner surface 40 defining the inlet passage 20. Each outlet 38 is typically positioned at a location proximate the leading edges 32 of the blades 18 of the compressor wheel 16, e.g., proximate the radially outermost tips of the leading edges 32 of the blades 18. Thus, the ports 36 are configured to inject the compressed air into the inlet passage 20 proximate the leading edges 32 and thereby reduce the incidence of surging. As shown in FIG. 1, each injection port 36 can extend in a radial direction between a respective one of the outlets 38 and one of the flow channels 42 or directly from the outlet 38 to the circumferential channel 35. Alternatively, the injection ports 36 can be configured at an angle relative to the radial direction. For example, each injection port 36 can be angled circumferentially relative to the radial direction so that the injection ports 36 are configured to inject the recirculated air with a circumferential velocity component corresponding to the direction of the rotation of the compressor wheel 16 (i.e., a pre-swirl direction) or opposite the direction of the compressor wheel 16 (i.e., a counter-swirl direction). In addition, or alternative, each injection port 36 can be disposed at an angle relative to the axial direction, e.g., as shown in FIG. 2 so that the recirculated air is injected with an axial velocity component.

In some cases, the configuration of the injection ports 36 and/or the fluid channels 42 can be configured to facilitate the manufacture of the housing 12. For example, as shown in FIG. 1, the portion of the housing 12 defining the injection port 36 can be formed as a single unitary member that also defines all or part of the inlet passage 20 and diffuser passage 22, in which case it may be difficult to access the radially inner surface 40 of the housing 12 with a drilling device to form the injection ports 36 as cylindrical bores. Therefore, forming the injection port 36 as a circumferential channel can facilitate manufacture, as the circumferential channel can be formed with a cutter wheel or other machining tool that can be inserted into the housing 12 and moved radially against the surface 40.

Alternatively, in another embodiment of the present invention, the housing 12 can include multiple body portions that are individually formed and then assembled during manufacture of the compressor 10. In this regard, the inlet duct 21 of the compressor 10 illustrated in FIG. 2 is formed separately from the rest of the housing 12. The inlet duct 21 defines at least part of the radially inner surface 40 including the outlets 38, as well as the injection ports 36 and the flow channels 42. The flow channels 42 and injection ports 36 can be formed in the inlet duct 21 before the inlet duct 21 is assembled with the rest of the housing 12, i.e., so that a drill or other tool can easily be configured in position to form the injection port 36 with the desired configuration. For example, the injection port 36 can be drilled as a cylindrical bore that extends through the inlet duct 21 so that when the inlet duct 21 is assembled with the rest of the housing 12, the injection port 36 extends at an angle relative to the radial direction. The injection port 36 can be angled relative to the axial direction as shown in FIG. 2 so that the recirculated air is injected with an axial velocity, and/or the injection port 36 can be angled circumferentially as described above so that the recirculated air is injected with a circumferential component of velocity. Further, if multiple injection ports 36 are provided, the injection ports 36 can be angled similarly or can define different angles relative to the radial and/or axial directions. In any case, the housing 12 can also include additional members, and the inlet duct 21 and other portions of the housing 12 can be connected by a press fit, weld joint, bolts or other connectors, and the like.

The outlet 38 of each injection port 36 is typically disposed proximate the leading edges 32 of the compressor wheel 16 and configured to thereby control a surge characteristic of the compressor 10. For example, as illustrated in FIG. 1, each outlet 38 can be positioned just upstream of the leading edges 32 of the compressor wheel 16. Thus, compressed air is recirculated through the injection port 36 and delivered to the leading edges 32 of the blades 18. In particular, the compressed air is injected into the inlet passage 20 at a location proximate the radially outermost tips of the leading edges 32 of the blades 18. If the injection ports 36 are angled relative to the axial direction, as illustrated in FIG. 4, the recirculated air can be directed from the outlets 38 directly toward the compressor wheel 16. In any case, the recirculation of air through the injection ports 36 can reduce the likelihood and occurrence of surging of the compressor 10. Although the present invention is not intended to be limited to any particular theory of operation, it is believed that the provision of recirculated air through the injection ports 36 can increase the axial velocity of the air in the inlet passage 20, thereby reducing the incidence angle of the flow at the leading edges 32 of the blades 18 and thus reducing surging. Further, the recirculation also increases the radial velocity of the flow exiting the compressor 10 into the diffuser passage 22, thereby reducing the likelihood of flow separation at the trailing edges 34 of the blades 18 in the diffuser 22. In some cases, the direction of the injection ports 36 can also improve the prevention of surging, e.g., by providing a particular axial or circumferential velocity component to the recirculated air.

In some modes of operation, the recirculation of air through the injection port 36 can reduce the efficiency of the compressor 10. However, the compressor 10 can be controllable to selectively provide an adjustable amount of recirculated air flow. Thus, by controlling the rate of flow of the recirculated air, the compressor 10 can reduce the occurrence of surging as required for a particular application or mode of operation while also minimizing the reduction in efficiency. In this regard, the compressor 10 includes a flow control device 60 that is configured to control the flow of the compressed air through the recirculation passage 41 to the injection ports 36. In particular, a controller 62 can selectively adjust the flow control device 60 according to one or more operating parameters of the compressor 10 or a device operating in conjunction with the compressor 10, such as a turbocharger or engine associated with the compressor 10. For example, the controller 62 can adjust the flow control device 60 according to the operating speed of an engine that is configured to receive compressed air from the compressor 10 as intake air. Typically, the controller 62 increases the flow rate of recirculated air for decreasing speeds of the engine and/or increasing torque or loads, but in some embodiments of the present invention, the flow rate of the recirculated air can be adjusted according to other parameters and/or independently of the speed and/or load of the engine.

The actual amount of recirculated air flow can be determined according to the adjustment of the flow control device 60 as well as other characteristics of the compressor 10 such as the operating pressures throughout the recirculation passage 41 and at the outlets 38 of the injection ports 36; the size and configuration of the recirculation passage 41, connection port 37, chamber 35, flow channels 42, injection ports 36; the number of the flow channels 42 and injection ports 36; and the like.

In any case, the flow control device 60 can include one or more fluid valve, each configured to selectively control a flow of the compressed air through the recirculation passage. For example, in the embodiment illustrated in FIG. 1, the flow control device 60 can be a single valve that includes an electric actuator 64 such that the flow control device 60 is configured to be electronically adjusted by the controller 62 before and/or during operation of the compressor 10.

FIG. 3 illustrates the operation of the controller 62 and the flow control device 60 according to one embodiment of the present invention in which the compressor 10 is used to provide compressed air to an engine with an exhaust gas return (EGR) system and a variable nozzle turbine (VNT) turbocharger. The controller 62 begins a control sequence at Block 100 by preparing for a control subroutine, e.g., by initializing data values, resetting equipments positions, performing test operations, and the like. In Block 102, the controller 62 receives input data including the operational positions of the EGR valve and VNT nozzles. The controller 62 adjusts the flow control device 60 to the closed position. See Block 104. Next, in Block 106, the controller 62 compares the current rotational speed of the engine (Erpm) to a predefined value engine speed N. If the speed of the engine Erpm is less than the predefined speed N, the controller 62 adjusts the flow control device 60 to an open configuration, thereby providing recirculated air to the injection ports 36. See Block 108. Thereafter, or if the engine speed Erpm is not less than the predefined speed N, the controller 62 proceeds to Block 110, in which the control subroutine ends. The controller 62 can immediately return to Block 100 to restart the operation of the subroutine or retest at a designated time.

In some embodiments of the present invention, the flow control device 60 can provide multiple selectable flow rates. For example, the flow control device 60 can be adjustably controlled throughout a range of positions therebetween so that the flow is adjusted. Alternatively, the flow control device 60 can include two or more valves that are arranged in a fluidly parallel configuration so that each valve can be used to selectively and/or independently control a parallel flow of the compressed air through the recirculation passage 41 to the injection ports 36. As shown in FIG. 4, each of the valves V1, V2 can communicate with the controller 62 and independently open or close in response to a signal from the controller 62. Further, each of the valves V1, V2 can be configured to provide a different rate of flow therethrough. For example, in the embodiment illustrated in FIG. 4, the second valve V2 is configured to provide a flow greater than the first valve V1. Thus, the valves V1, V2 can thus be configured to provide four distinct rates of flow through the recirculation passage, as illustrated in FIG. 4A, by selectively opening and closing the respective valves V1, V2.

Any number of the valves can be provided. For example, in another embodiment illustrated in FIG. 5, the flow control device 60 includes three valves V1, V2, V3. The third valve V3 is configured to provide a flow greater than the first and second valves V1, V2, and the second valve V2 is configured to provide a flow greater than the first valve V1. Thus, the valves V1, V2, V3 can be configured to provide at least eight distinct rates of flow through the recirculation passage 41, as illustrated in FIG. 5A, by selectively opening and closing the respective valves V1, V2, V3. In other embodiments of the present invention, other numbers of valves can be provided. In any case, each of the valves can include an electromagnetically operated actuator 64 for adjusting the valves V1, V2, V3, and the valves V1, V2, V3 can be configured in a parallel flow array to provide any number of distinct flow rates through the recirculation passage 41.

FIG. 6 illustrates the operation of the controller 62 and the flow control device 60 according to another embodiment of the present invention in which the flow control device 60 includes two valves V1, V2, such as the embodiment described above in connection with FIG. 4. The controller 62 begins operation at Block 120, which can include initialization operations similar to Block 100 above. The controller 62 determines the current rotational speed Erpm of the engine at Block 122. Proceeding through Block 124 to Block 126, the controller 62 compares the engine speed Erpm to a first predefined value of engine speed N1. If the speed of the engine Erpm is greater than the first predefined speed N1, the controller 62 adjusts both of the valves V1, V2 to the closed configuration so that no compressed air is recirculated through the injection ports 36, i.e., a first rate of recirculation equal to zero. See Block 128. However, if the engine speed Erpm is less than the first predefined engine speed N1, the controller 62 also determines if the speed Erpm is greater than a second predefined engine speed N2 (Block 130) and, if so, opens the first valve V1 while the second valve V2 is closed, thereby providing recirculation at a second rate. See Block 132. The controller 62 next determines if the engine speed Erpm is less than N2 but greater than a third predefined engine speed N3 (Block N3), and if so, opens the second valve V2 while the first valve V1 is closed to thereby provide recirculation at a third rate. See Block 136. If the controller 62 determines that the engine speed Erpm is less than the third predefined speed N3 (Block 138), the controller 62 opens both valves V1, V2 so that the compressed air is recirculated at a fourth (maximum) rate. Although omitted from the chart for purposes of illustrative clarity, it is understood that the controller 62 can proceed at any time, such as after configuring the valves V1, V2 in Blocks 128, 132, 136, or 140, to Block 142, where the controller 62 again checks the engine speed Erpm and returns to Block 124 to repeat the foregoing tests.

Similarly, FIG. 7 illustrates the operation of the controller 62 and the flow control device 60 according to yet another embodiment of the present invention in which the flow control device 60 includes three valves V1, V2, V3, such as the embodiment described above in connection with FIG. 5. The controller 62 begins operation at Block 160, which can include initialization operations similar to Blocks 100 and 120 above. The controller 62 determines the current rotational speed Erpm of the engine at Block 162. Proceeding through Block 164 to Block 166, the controller 62 compares the engine speed Erpm to a first predefined value of engine speed N1. If the speed Erpm of the engine is greater than the first predefined speed N1, the controller 62 adjusts all of the valves V1, V2, V3 to the closed configuration so that no compressed air is recirculated through the injection ports 36, i.e., a first rate of recirculation equal to zero. See Block 168. However, if the engine speed Erpm is less than the first predefined engine speed N1, the controller 62 also determines if the speed Erpm is greater than a second predefined engine speed N2 (Block 170) and, if so, opens the first valve V1 while the second and third valves V2, V3 are closed, thereby providing recirculation at a second rate. See Block 172. The controller 62 next determines if the engine speed Erpm is less than N2 but greater than a third predefined engine speed N3 (Block 174), and if so, opens the second valve V2 while the first and third valves V1, V3 are closed to thereby provide recirculation at a third rate. See Block 176. If the controller 62 determines that the engine speed Erpm is less than the third predefined speed N3 but greater than a fourth predefined engine speed N4 (Block 178), the controller 62 opens the first and second valves V1, V2 while the third valve V3 is closed so that the compressed air is recirculated at a fourth rate. See Block 180. If the engine speed Erpm is less than the fourth predefined speed N4 but greater than a fifth predefined engine speed N5 (Block 182), the controller 62 opens the third valve V3 while the first and second valves V1, V2 are closed so that the compressed air is recirculated at a fifth rate. See Block 184. If the controller 62 determines that the engine speed Erpm is less than the fifth predefined speed N5 but greater than a sixth predefined engine speed N6 (Block 186), the controller 62 opens the first and third valves V1, V3 while the second valve V2 is closed so that the compressed air is recirculated at a sixth rate. See Block 188. If the controller 62 determines that the engine speed Erpm is less than the sixth predefined speed N6 but greater than a seventh predefined engine speed N7 (Block 190), the controller 62 opens the second and third valves V2, V3 while the first valve V1 is closed so that the compressed air is recirculated at a seventh rate. See Block 192. If the controller 62 determines that the engine speed Erpm is less than the seventh predefined speed N7 (Block 194), the controller 62 opens all of the valves V1, V2, V3 so that the compressed air is recirculated at an eighth (maximum) rate. See Block 196. Typically, after adjusting the valves V1, V2, V3 to any of the configurations, the controller 62 proceeds to Block 198, again checking the engine speed Erpm, and then returning via Block 200 to Block 164 to repeat the foregoing tests.

As described above, the recirculation of air to the inlet passage 20 can reduce surging in the compressor 10 and expand the useful working area of the compressor 10. FIG. 8 schematically illustrates the typical surging characteristics of a compressor according to one embodiment of the present invention compared to the surging characteristics of a conventional compressor. Lines 210, 212 illustrate the typical pressure ratio (between the air exiting the compressor and the air entering the compressor) and air flow conditions of a compressor without exhaust gas recirculation and a compressor with exhaust gas recirculation, respectively. As illustrated, the operating line 212 indicates that a higher pressure ratio is required to maintain a particular air flow when exhaust gas is recirculated. Line 214 indicates the surge conditions for a conventional compressor, i.e., the pressure ratio above which the compressor is subject to surging. It can be seen that the operating line 212 crosses the surge line 214. Thus, the compressor will be subject to surging at the indicated operating conditions. Line 216 illustrates the surge conditions for a compressor according to one embodiment of the present invention. The surge line 216 is shifted relative to the surge line 214 for a conventional compressor. Thus, the compressor having recirculation of air to the inlet passage according to the present invention can operate throughout a greater range of operating conditions without surging, thereby expanding the operational range of other devices operating in conjunction with the compressor such as a turbocharger and/or an engine. For example, the operating line 212 does not cross the surge line 216.

The compressor 10 and/or the other devices operating in conjunction with the compressor 10 can include any of various other devices, such as those provided in conventional compressors, turbochargers, and combustion engines. For example, the compressor 10 can include an air cooling device for cooling the recirculated air. Such a cooling device is further described in copending International Application No. PCT/US03/25029, titled "Surge Control System for a Compressor," filed Aug. 8, 2003. However, it is appreciated that by selectively controlling the flow rate of the recirculated air, the temperature of the air in the compressor 10 can also be controlled and, in some cases, cooling of the air is typically not necessary.

Many modifications and other embodiments of the invention set forth herein will come to mind to one skilled in the art to which this invention pertains having the benefit of the teachings presented in the foregoing descriptions and the associated drawings. For example, it is appreciated that each of the components of the present invention can be formed of any conventional structural materials including, for example, steels, titanium, aluminum, and other metals. Therefore, it is to be understood that the invention is not to be limited to the specific embodiments disclosed and, that modifications and other embodiments are intended to be included within the scope of the appended claims. Although specific terms are employed herein, they are used in a generic and descriptive sense only and not for purposes of limitation.

That which is claimed:

1. A centrifugal compressor configured to provide a flow of recirculated air for surge control, the compressor comprising:

a housing defining an axial inlet passage, a radial diffuser passage, an exit, and at least one injection port, each injection port extending to an outlet on an inner surface of the inlet passage;

a compressor wheel defining a plurality of blades, each blade having a leading edge adjacent the inlet passage and a trailing edge adjacent the diffuser passage, the compressor wheel rotatably mounted in the housing such that the compressor wheel is configured to receive air flowing generally axially in the inlet passage at the leading edges of the blades and deliver the air from the trailing edges of the blades in a generally radial direction to the exit, the leading edges being configured proximate the outlet of the injection port;

a recirculation passage fluidly connected to the exit and configured to receive a flow of compressed air from the compressor wheel and deliver the compressed air through the injection port to the leading edges of the blades of the compressor wheel; and an adjustable flow control device configured to control the flow of the compressed air through the recirculation passage to the injection port to thereby control a surge characteristic of the compressor, wherein the flow control device includes first and second valves in a fluidly parallel configuration, each of the valves being independently controllable between open and closed positions for controlling a respective flow of compressed air through each valve, such that the flow control device is configured to provide at least three different rates of flow of the compressed air to the at least one injection port, and wherein the flow control device is configured to combine the two flows of compressed air downstream of the valves and upstream of the at least one injection port.

2. A centrifugal compressor according to claim 1 wherein the first and second valves are configured to provide dissimilar rates of flow in the open configuration such that the control device is configured to provide at least four different rates of flow of the compressed air to the injection port.

3. A centrifugal compressor according to claim 1 wherein the flow control device comprises an electromagnetic actuator for each valve, configured to adjust the valve such that the flow of the compressed air to the injection port can be adjusted electronically.

4. A centrifugal compressor according to claim 1, further comprising an electronic controller configured to detect an operating parameter of an internal combustion engine and control the flow of the compressed air to the injection port according the operating parameter.

5. A centrifugal compressor according to claim 1 wherein the housing comprises an inlet duct defining a least a portion of the inner surface of the housing, wherein the inlet duct defines a circumferential chamber fluidly connecting the recirculation passage to the injection port.

6. A centrifugal compressor according to claim 1 wherein each injection port extends generally radially inward to the outlet.

7. A centrifugal compressor according to claim 6 wherein the housing defines a plurality of injection ports.

8. A centrifugal compressor according to claim 1 wherein each injection port is a bore.

9. A centrifugal compressor according to claim 1 wherein each injection port is disposed at an acute angle relative to the axial direction and directed toward the compressor wheel.

10. A centrifugal compressor according to claim 1 wherein the injection port is a slot extending circumferentially in the housing.

11. A centrifugal compressor according to claim 1 wherein the housing comprises a unitary body portion defining the at least one injection port and at least partially defining the inlet passage and the diffuser passage.

12. A centrifugal compressor according to claim 1 wherein the housing comprises first and second connected body portions, the first body portion defining the at least one injection port and the second body portion at least partially defining at least one of the group consisting of the inlet passage and the diffuser passage.

13. A centrifugal compressor according to claim 1 wherein each outlet is disposed proximate radially outer tips of the leading edges of the blades such that each injection port is configured to inject the compressed air into the inlet passage at a location proximate the radially outer tips of the leading edges.

14. A method for controlling a recirculation flow in a compressor, the method comprising:

providing a rotatable compressor wheel in a housing defining an axial inlet passage and a radial diffuser passage;

rotating a compressor wheel having a plurality of blades in a compressor housing such that the compressor wheel receives air flowing generally axially in the inlet passage at leading edges of the blades and delivers the air from trailing edges of the blades in a generally radial direction to the diffuser passage;

recirculating a flow of the compressed air from the compressor wheel to the inlet passage of the compressor through at least one outlet proximate the leading edges of the blades of the compressor wheel, wherein said recirculating step comprises recirculating the flow of the compressed air through a flow control device comprising first and second valves in a fluidly parallel configuration, each valve having a flow of compressed air therethrough, and wherein the flow control device combines the two flows of compressed air downstream of the valves and upstream of the inlet passage; and adjusting the flow of the compressed air to thereby control a surge characteristic of the compressor, said adjusting step comprising selectively adjusting each of the first and second valves between open and closed positions.

15. A method according to claim 14 wherein said adjusting step comprises adjusting each valve with an electric actuator during operation of the compressor.

16. A method according to claim 14 wherein said adjusting step comprises selectively adjusting the flow of the compressed air according to an operating parameter of a combustion engine configured to receive compressed air from the compressor.

17. A method according to claim 16 wherein said adjusting step comprises adjusting the flow according to a speed of the combustion engine.

18. A method according to claim 14 wherein the recirculating step comprises injecting the flow of recirculated air through a chamber extending around the inlet passage of the compressor and from the chamber to the inlet passage via at least one injection port extending from the chamber to the outlet.

19. A method according to claim 14 wherein said recirculating step comprises injecting the recirculated air to the inlet passage in a generally radial direction.

20. A method according to claim 14 wherein said recirculating step comprises injecting the recirculated air to the inlet passage in a direction defining an acute angle relative to the inlet passage and directed toward the compressor wheel.

21. A method according to claim 14 wherein said recirculating step comprises injecting the recirculated air to the inlet passage through at least one bore.

22. A method according to claim 14 wherein said recirculating step comprises injecting the recirculated air to the inlet passage through a slot extending circumferentially around the inlet passage.

23. A method according to claim 14 wherein said providing step comprises forming the housing of a unitary body portion defining the at least one outlet and at least partially defining the inlet passage and the diffuser passage.

24. A method according to claim 14 wherein said providing step comprises forming the housing of at least two connected body portions, the first body portion defining the outlet and the second body portion at least partially defining at least one of the group consisting of the inlet passage and the diffuser passage.

25. A method according to claim 14 wherein said recirculating step comprises injecting the compressed air into the inlet passage at a location proximate radially outer tips of the leading edges of the blades.

* * * * *